United States Patent [19]

Castonguay et al.

[11] Patent Number: 4,789,848

[45] Date of Patent: Dec. 6, 1988

[54] MOLDED CASE CIRCUIT BREAKER LATCH AND OPERATING MECHANISM ASSEMBLY

[75] Inventors: Roger N. Castonguay, Terryville; David J. Meiners, Southington, both of Conn.

[73] Assignee: General Electric Company, New York, N.Y.

[21] Appl. No.: 92,962

[22] Filed: Sep. 3, 1987

[51] Int. Cl.[4] ..... H01H 9/20

[52] U.S. Cl. ..... 335/167; 335/168; 335/172

[58] Field of Search ..... 335/172–176, 335/167–169, 166, 185

[56] References Cited

U.S. PATENT DOCUMENTS 3,936,780 2/1976 Hennemann ..... 335/168

4,622,530 11/1986 Ciarcia et al. ..... 335/167

*Primary Examiner*—E. A. Goldberg

*Assistant Examiner*—Lincoln Donovan

*Attorney, Agent, or Firm*—Richard A. Menelly; Walter C. Bernkopf; Fred Jacob

[57] ABSTRACT

An industrial rated molded case circuit breaker having an electronic trip circuit contained within the circuit breaker enclosure includes a reset spring in cooperation with the circuit breaker latch spring to insure manual reset of circuit breaker after an automatic trip function. The reset spring allows the circuit breaker latch assembly to be manually reset upon minimum travel of the circuit breaker operating handle due to internal circuit breaker component space restrictions. The circuit breaker latch assembly is robotically loaded to the operating mechanism which is then attached to the circuit breaker case by an automated fastening process.

13 Claims, 8 Drawing Sheets

MOLDED CASE CIRCUIT BREAKER LATCH AND OPERATING MECHANISM ASSEMBLY

BACKGROUND OF THE INVENTION

U.S. Pat. No. 4,736,174 filed Apr. 23, 1987 entitled "Molded Case Circuit Breaker Operating Mechanism" describes a circuit breaker operating mechanism that is down-loaded within the circuit breaker case in a completely automated assembly process. The operating mechanism is controlled by an electronic trip circuit contained within the circuit breaker case. The circuit breaker latching assembly is designed for allowing manual reset of the circuit breaker operating mechanism by operation of the circuit breaker handle. When auxiliary functions are provided to the circuit breaker by means of circuit breaker accessories mounted within the circuit breaker cover, such as described within U.S. Pat. No. 4,754,247 filed Jun. 12, 1987 entitled "Molded Case Circuit Breaker Accessory Enclosure" some additional space is required within the breaker enclosure such that the travel of the circuit breaker operating handle is somewhat limited. Since the travel of the circuit breaker operating handle is used to reset the circuit breaker operating mechanism after a tripping function, the limitation in the travel of the operating handle can interfere with the circuit breaker's reset operation. Both of the aforementioned U.S. patents are incorporated herein for reference purposes and should be reviewed for their teachings of the interaction between the circuit breaker operating mechanism and the latch assembly as well as for their disclosure of the arrangement of circuit breaker accessories within the circuit breaker cover.

When the circuit breaker internal components are down-loaded in an automated assembly process, some time is required for attaching the circuit breaker operating mechanism to the circuit breaker base by means of elongated machine screws. One purpose of the instant invention is to provide a rapid means for attaching the operating mechanism to the circuit breaker base without requiring machine screws. Another purpose of this invention is to provide means for resetting the circuit breaker operating mechanism within the limited travel of the circuit breaker operating handle.

SUMMARY OF THE INVENTION

A reset spring is attached to the circuit breaker latch assembly on an opposite side from the circuit breaker latch spring. The reset spring includes an extension member which inactivates a blocking member on the latch spring after the circuit breaker operating cradle has cleared the secondary latch part of the latch assembly. The operating cradle then disables the latch spring blocking member thereby allowing the latch spring to provide latching functions. The circuit breaker operating mechanism assembly includes a bifurcated-ended support frame accessible through the bottom of the circuit breaker case. A forming tool is inserted within a part of the circuit breaker case to displace the bifurcated-ends within complimentary recesses formed within the bottom of the circuit breaker case.

DESCRIPTION OF THE PREFERRED EMBODIMENT

Figure 1:
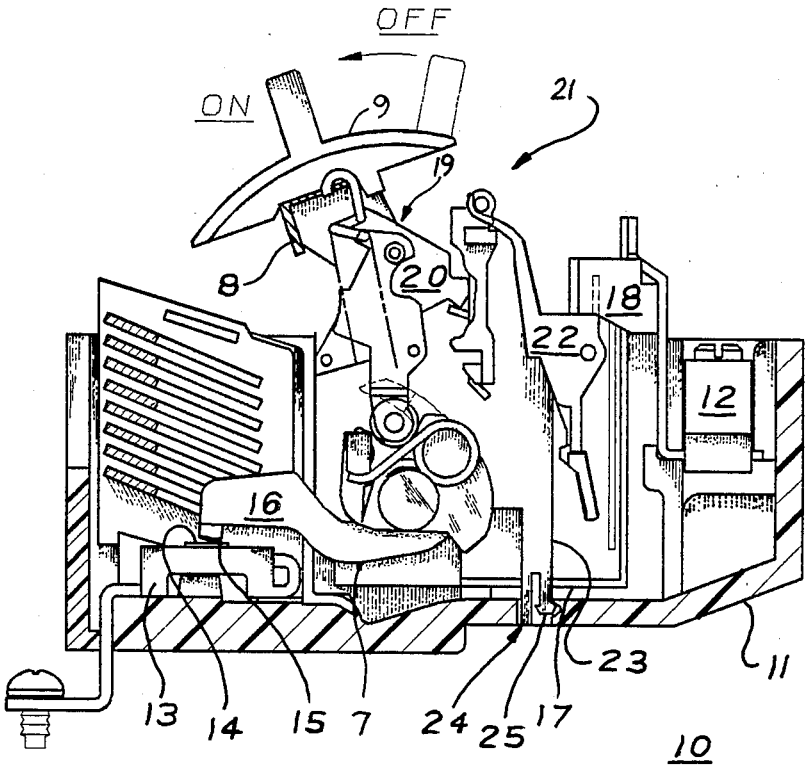
FIG. 1 is a side view, in partial section, of a circuit breaker containing the latch assembly and operating mechanism attachment means according to the invention.

A molded case circuit breaker 10 is shown in FIG. 1 consisting of a molded plastic case 11 to which an electrical load is attached at one end by means of a load lug 12. The circuit breaker is connected within a power system by means of the line terminal connector 13. The circuit current proceeds from the line terminal connector through a fixed contact 14 and a movable contact 15 to a movable contact carrier 16. The movable contact carrier is connected to a trip unit 18 by means of a contact carrier support 7 and conductor 17. Upon the occurrence of an overcurrent condition, the trip unit responds to articulate the operating mechanism generally depicted at 19 which is held in a latched condition by means of a cradle 20 and latch assembly 21. The trip unit motivates a trip bar 22 which in turn dislodges the latch assembly 21 from the operating cradle 20 to allow the operating mechanism to separate the contacts 14, 15 resulting in a "TRIPPED" condition. To return the contacts to their closed condition, the handle operator 9 which connects with the operating mechanism by means of the handle yoke 8, is then rotated counterclockwise from the "OFF" position to the "ON" position, as indicated. The operating mechanism 19 is supported within a pair of opposing side frames 23, one of which is removed to show the attachment between the side frames and the circuit breaker case 11 by means of a bifurcated foot portion 24 and a recess 25 formed within the case. The attachment between the side frame 23 and the circuit breaker case 11 will be discussed below in greater detail.

Figure 2:
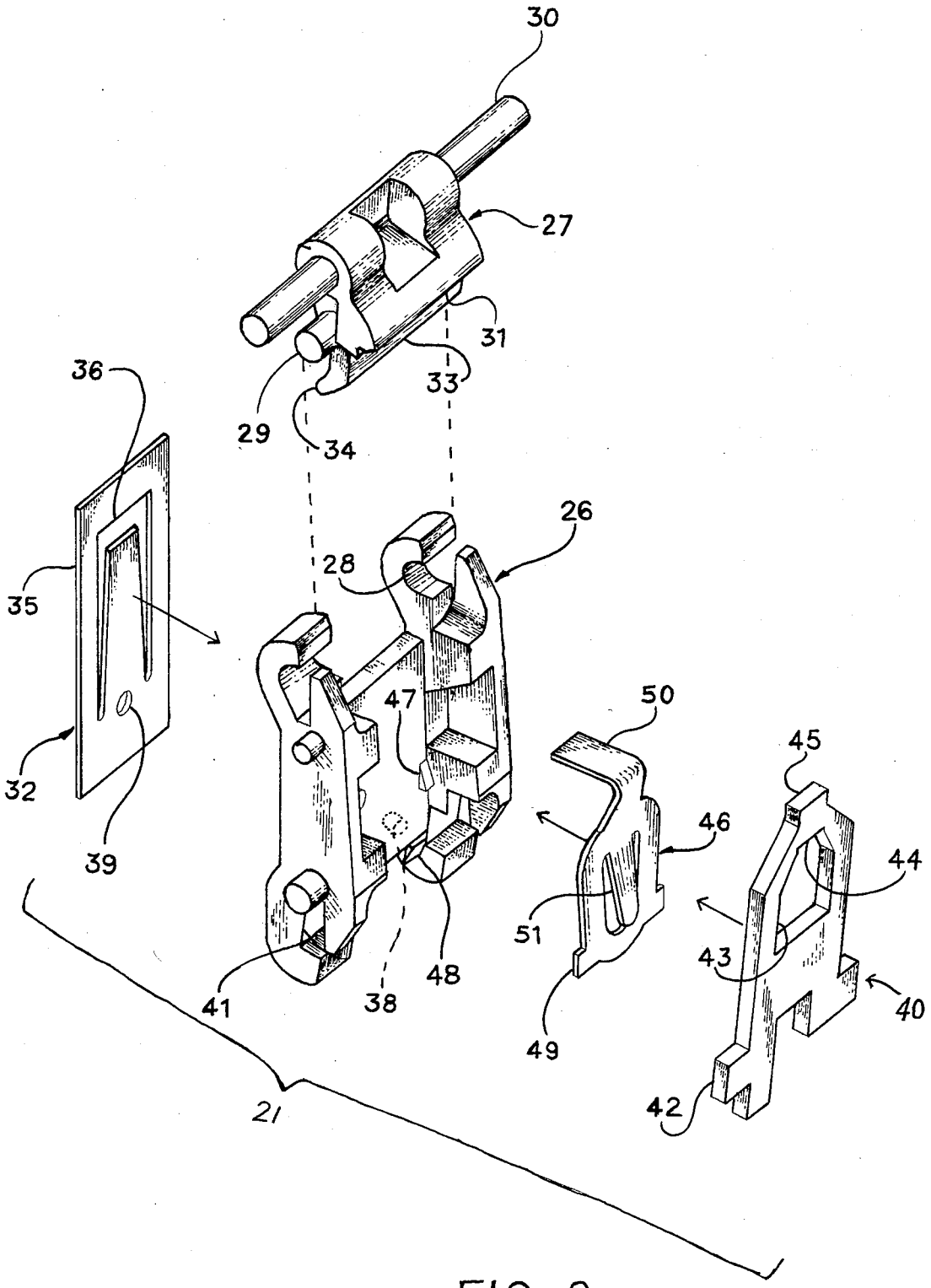
FIG. 2 is a top perspective view of the latch assembly within the circuit breaker of FIG. 1 in isometric projection.

The latch assembly 21 is shown in FIG. 2 to consist of the following components. A latch support 26 formed from a single metal casting retains the secondary latch return spring 32 on one side with the secondary latch 27, primary latch 40 and reset spring 46 mounted on the opposite side thereof. The secondary latch return spring 32 is fastened to the latch support 26 by means of a support post 38 formed on the bottom of the latch support and a clearance hole 39 formed through the bottom of the secondary latch return spring 32. The secondary latch return spring is formed from a single metal stamping of steel with a blocking member 36 lanced within the secondary latch return spring and a U-shaped secondary latch return surface 35 formed along a top part thereof. The secondary latch 27 is pivotally supported on the latch support 26 by the insertion of a pair of secondary latch pivot posts 29 extending from opposite sides of the secondary latch within corresponding support slots 28 formed on opposite sides of the latch support. The secondary latch 27 is similar to that described within the earlier referenced U.S. Pat. No. 4,736,174. The secondary latch presents a rearwardly extending primary latch latching surface 31 and a pair of actuator posts 30 extending from opposite sides thereof. An unlatching plate 33 formed on the bottom of the secondary latch presents an unlatching surface 34 for interacting with the secondary latch return spring blocking member 36 in a manner to be described below, in greater detail. The reset spring 46 is supported upon the latch support 26 by positioning a pair of tabs 49 formed on the bottom of the reset spring, between tabs 47, 48 formed on the latch support 26. The extension 50 on the top surface of the reset spring 46 is arranged for contacting with the secondary latch return spring blocking member 36 in a manner to be described below in greater detail. A primary latch reset surface 51 is lanced within the reset spring for cooperating with the primary latch 40 which is next attached to the latch support 26 by trapping the pair of posts 42 formed on the bottom of the primary latch within the corresponding pair of slots 41 formed in the bottom of the latch support 26. The primary latch includes a cradle latching surface 44 formed within the top of an aperture 43 and a secondary latch latching surface 45 formed at the uppermost part thereof. The secondary latch latching surface 45 on the primary latch 40 is retained under the secondary latch latching surface 31 on the secondary latch 27 when the latch assembly is in its latched condition. The aperture 43 in the primary latch 40 allows the operating cradle 20 (FIG. 1) to become trapped under the cradle latching surface 44 when the latch assembly is in its latched condition.

Figure 3:
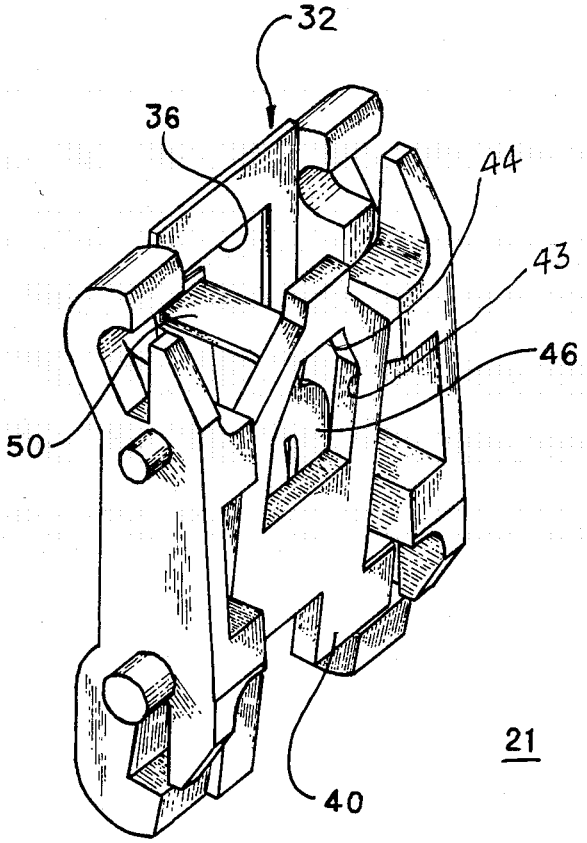
FIG. 3 is an enlarged top perspective view of the latch arrangement of FIG. 2 after assembly of the component parts.

The latch assembly 21 is depicted in FIG. 3 in its latched condition with the secondary latch 27 of FIG. 2 removed to show the interaction between the extension 50 on the reset spring 46 and the secondary latch return spring blocking member 36 formed on the secondary latch return spring 32. The primary latch 40 is also depicted in its latched position with respect to the secondary latch. The cradle 20 of FIG. 1, omitted for purposes of clarity, is retained under the cradle latching surface 44 and extends partially within the aperture 43 when the latch assembly is in its latched condition.

Figure 4:
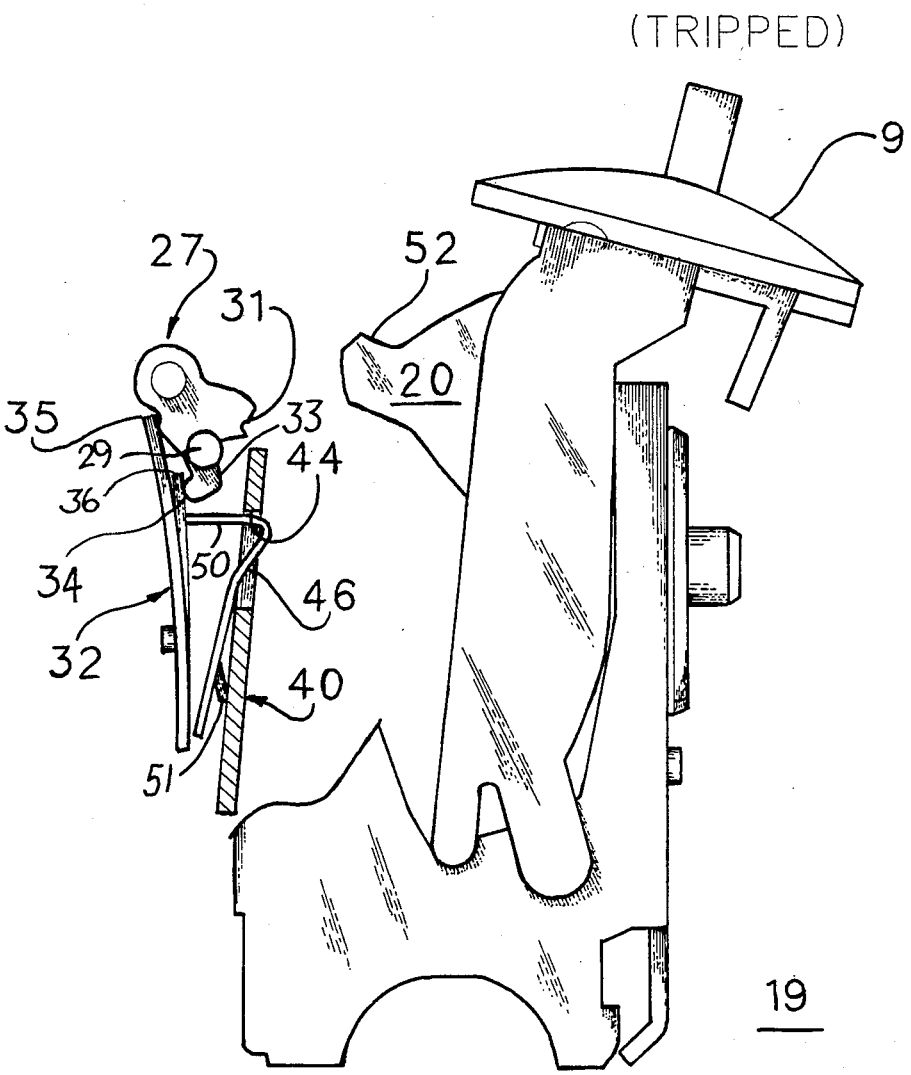
FIG. 4 is a side view of the operating mechanism and latch assembly within the circuit breaker of FIG. 1 depicted in a "TRIPPED" position.

The operating mechanism 19 is shown in FIG. 4 in its "TRIPPED" condition such that the handle operator 9 is intermediate the "ON" and "OFF" positions indicated earlier in FIG. 1. The latching surface 52 of the cradle 20 is released from under the cradle latching surface 44 on the primary latch 40 and the primary latch itself is released from the primary latch latching surface 31 on the secondary latch 27. Once the operating mechanism 19 has moved to the "TRIPPED" position, the primary latch 40 is urged to its unlatched position by the bias provided by the primary latch reset surface 51 on the reset spring 46. At the same time, the secondary latch return spring blocking member 36 contacts the unlatching plate surface 34 on the unlatching plate 33 which restrains the secondary latch 27 from rotating clockwise about the secondary latch pivot posts 29. The secondary latch return spring U-shaped surface contacts the secondary latch 35 but is unable to rotate the secondary latch 27 clockwise about pivot posts 29 because of the interference between the extension 50 on the reset spring 46 and the reset spring blocking member 36 on the secondary latch return spring 32.

Figure 5:
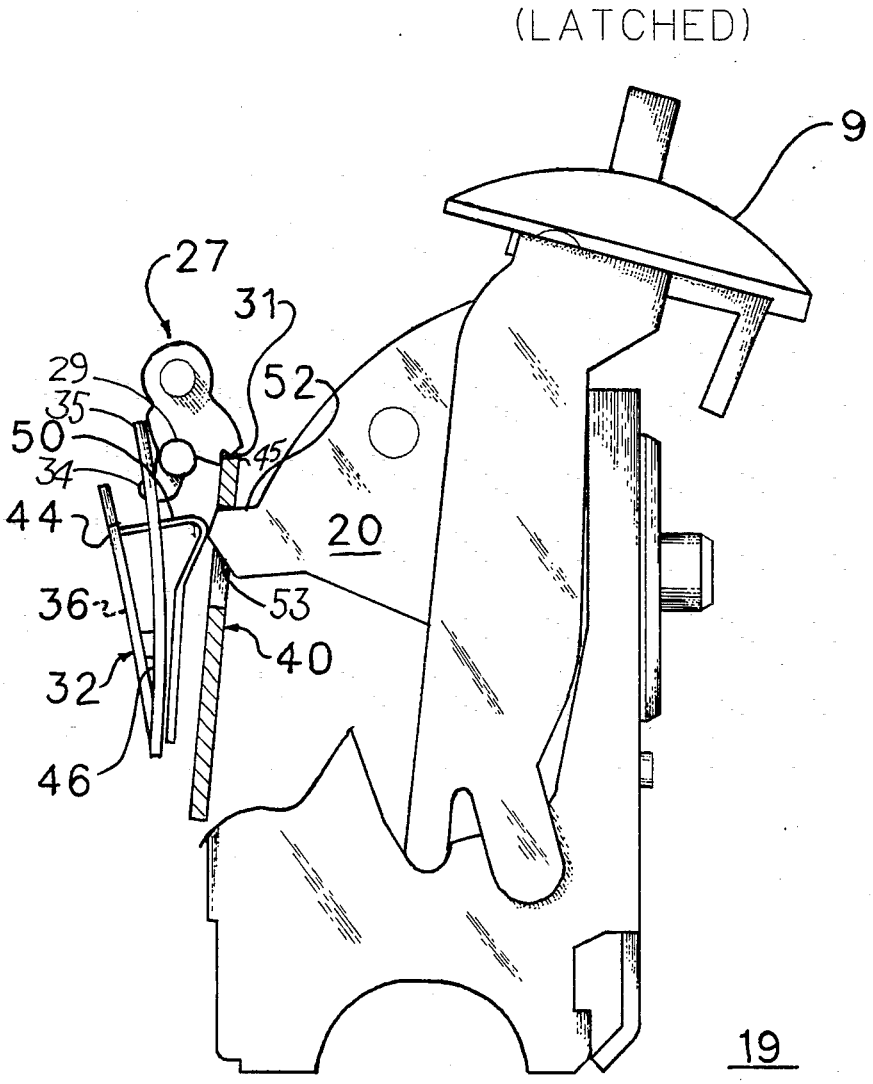
FIG. 5 is a side view of the operating mechanism and latch assembly of FIG. 4 depicted in a "LATCHED" position.

In order to reset the circuit breaker operating mechanism 19 the operating handle 9 is moved to the "LATCHED" position indicated in FIG. 5. This brings the latching surface 52 of the operating cradle 20 under the cradle latching surface 44 of the primary latch 40 and locates secondary latch latching surface 45 of the primary latch 40 in contact with the primary latch latching surface 31 on the secondary latch 27 as indicated. The operating cradle 20 contacts the reset spring 46 and "disarms" the secondary latch return spring blocking member 36 on the secondary latch return spring 32 by moving the extension 50 on the reset spring 46 into contact with the secondary latch return spring blocking member 36 and displacing the secondary latch return spring blocking member away from the secondary latch unlatching surface 34. The secondary latch 27 is now able to rotate clockwise about the secondary latch pivot posts 29 to bring the secondary latch latching surface 45 on the primary latch 40 under the primary latch latching surface 31 on the secondary latch 27.

Figure 6A:
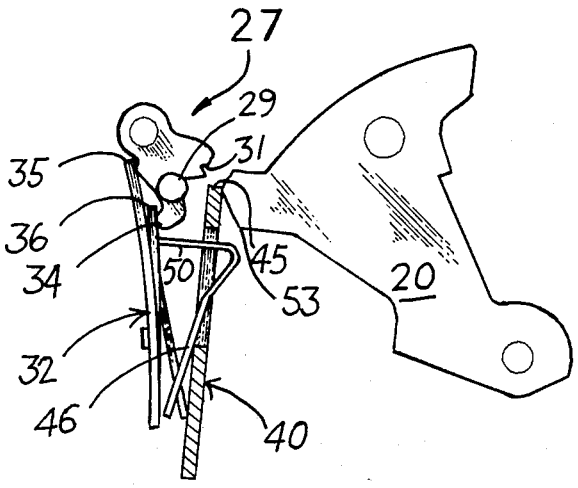
FIGS. 6A and 6B are side views of the latch assembly of preceding FIGS. 4 and 5 during a reset function.
Figure 6B:
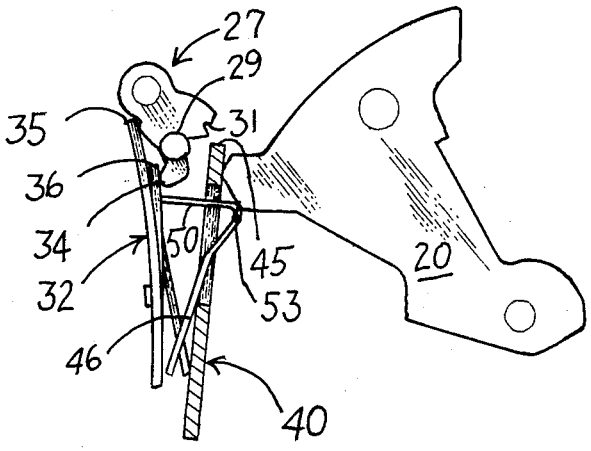

The movement of the cradle 20 from the "TRIPPED" position in FIG. 4 to the "LATCHED" position in FIG. 5 is best seen by referring also to FIGS. 6A and 6B. Moving the handle operator 9 in FIG. 5 counterclockwise rotates the reset surface 53 on the cradle 20 past the secondary latch 27, which is held from rotating in a clockwise direction under the urgence of the secondary latch return spring surfaces 35 on the secondary latch return spring 32, by the contact between the secondary latch return spring blocking member 36 and the unlatching surface 34 on secondary latch 27, as described earlier. As the cradle 20 continues rotating in its counterclockwise direction, the reset surface 53 on the cradle 20 contacts a part of the extension 50 on reset spring 46 moving the secondary latch return spring blocking member 36 out of contact with the unlatching surface 34 of the secondary latch 27 thereby allowing the secondary latch 27 to rotate in a clockwise direction about the secondary latch pivot posts 29, under the urgence of the secondary latch return spring surface 35 allowing the primary latch latching surface 31 on secondary latch 27 to trap the secondary latch surface 45 on the primary latch 40. It is noted that the provision of extension 50, reset spring 46, secondary latch spring blocking member 36 on secondary latch return spring 32 and unlatching surface 34 on latch 27 allow the transition from the "TRIPPED" to "LATCHED" position with a limited movement of the handle operator 9 in the counterclockwise direction as viewed in FIG. 1.

Figure 7:
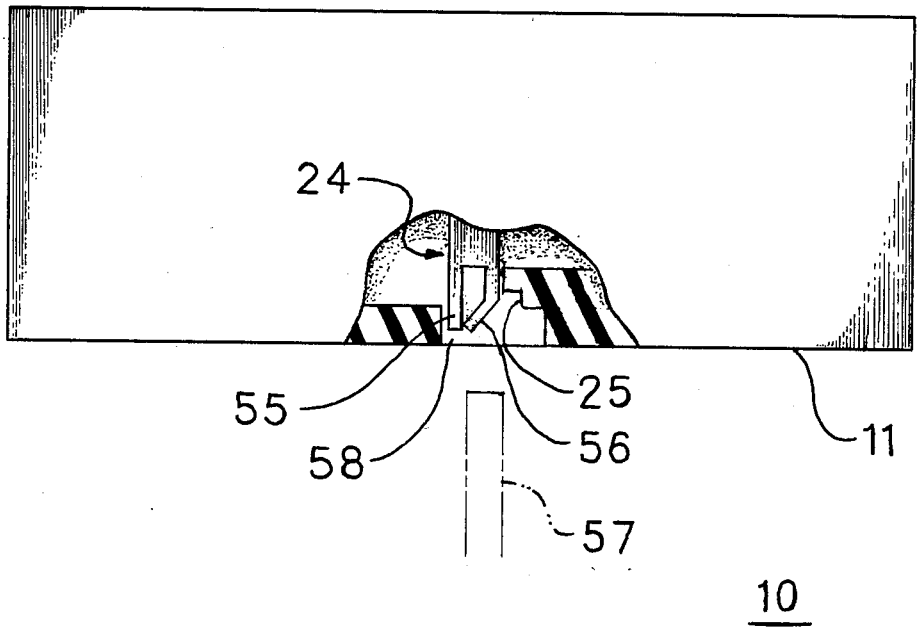
FIG. 7 is a side view of the circuit breaker of FIG. 1 with the cover attached prior to attachment of the operating mechanism to the circuit breaker case.
Figure 8:
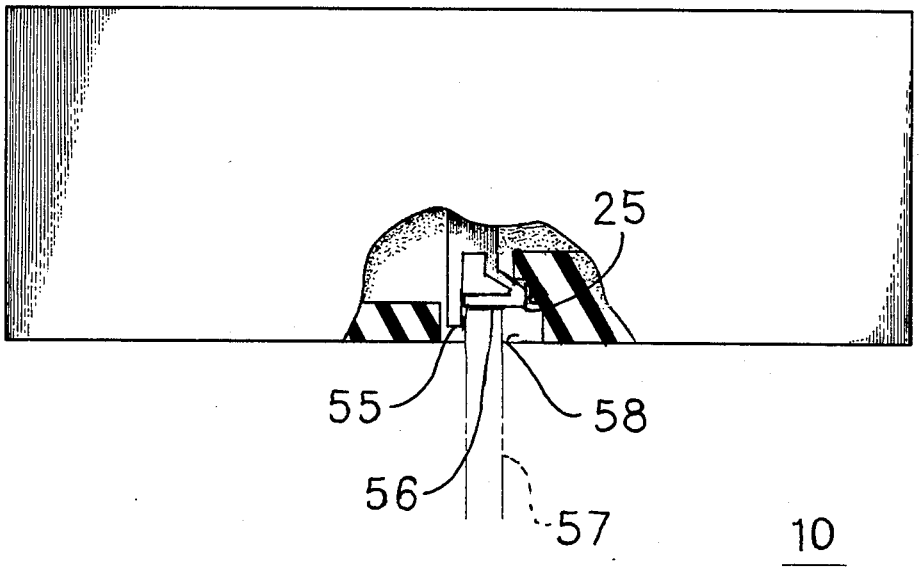
FIG. 8 is a side view of the circuit breaker depicted in FIG. 7 after attachment of the operating mechanism to the circuit breaker case.

When the complete latch assembly 21 of FIG. 1 is loaded onto the operating mechanism 19, and the operating mechanism is positioned within the circuit breaker case 11, the bifurcated foot 24 of the side frame 23 extends down next to the recess 25 formed within the bottom of the circuit breaker case 11. As best seen by referring now to the circuit breaker 10 in FIGS. 7 and 8, a forming tool 57 is inserted within the aperture 58 extending through the bottom of the circuit breaker case 11 and contacts the angled plate 56 forming one part of the bifurcated foot 24. The forming tool 57 drives the angled plate 56 into contact with the straight plate 55 forming the other part of the bifurcated foot 24. Continued movement of the forming tool then forces part of the angled plate 56 under the recess 25 formed within the circuit breaker case. The trapping of the angled plate 56 between the straight plate 55 and the recess 25 formed within the circuit breaker case prevents the operating mechanism from being withdrawn from the circuit breaker case without requiring any additional fastening means such as screws or rivets.

A latching arrangement has herein been disclosed for resetting circuit breaker operating mechanism with limited travel of the circuit breaker operating handle. Further disclosed are means for automatically attaching the circuit breaker operating mechanism to the circuit breaker case without requiring any additional fastening means.

Having thus described my invention, what I claim as new and desire to secure by Letters Patent is:

1. A latch arrangement for molded case circuit breakers comprising;

a support frame having a pair of side pieces joined by a back plate, each of said side pieces having a slot formed in a top part thereof;

a secondary latch having a primary latch latching surface formed on a bottom part, a first pair of posts extending outboard from said bottom part for insertion within corresponding receptacles formed within said side pieces and a second pair of posts extending from a top part of said secondary latch for interacting with a circuit breaker trip bar to rotate said secondary latch counterclockwise about said first pair of posts;

a reset spring intermediate said back plate and said secondary latch, said reset spring including a top member extending from a central body member over said back plate, said central body member including a reset surface lanced therein.

a primary latch pivotally mounted on said support frame under said secondary latch and consisting of an apertured body member defining a cradle latching surface within said aperture with a secondary latch latching surface formed on a top part of said body member; and a secondary latch return spring on a side of said back plate opposite said reset spring and having a U-shaped surface interfacing with said secondary latch to rotate said secondary latch clockwise about said first pair of posts and a lanced central surface interfacing with said top member for preventing said secondary latch from rotating about said first pair of posts.

2. The latching arrangement of claim 1 further including a primary latch latching surface formed on a bottom part of said secondary latch for interfacing with said top part of said body member.

3. The latching arrangement of claim 1 including an unlatching plate formed on said secondary latch bottom part for interfacing with said lanced central surface to bias said secondary latch for counterclockwise rotation about said first pair of posts.

4. The latching arrangement of claim 1 wherein said secondary latch return spring includes means for attachment to said back plate.

5. The latching arrangement of claim 4 wherein said attachment means comprises an aperture.

6. A molded case circuit breaker comprising:

a molded plastic case;

a pair of separable contacts arranged within said case for interrupting circuit current through a protected electric circuit upon the occurrence of an overcurrent condition;

an operating mechanism within said case proximate said contacts and biased for separating said contacts by means of an over-center operating spring;

a latching assembly within said case comprising a support frame carrying a secondary latch pivotally attached to a top part of said support frame and a primary latch pivotally attached to a bottom part of said support frame, a reset spring arranged on said support frame intermediate said primary latch and one side of said support frame, a return spring arranged on an opposite side of said support frame; and an operating cradle on said operating mechanism having a cradle hook interfacing with said primary latch and preventing said operating mechanism from separating said contacts while said cradle hook is retained by said primary latch, said primary latch releasing said cradle hook upon said overcurrent condition to allow said contacts to separate and interrupt said circuit current.

7. The circuit breaker of claim 6 including an unlatching plate formed on a bottom of said secondary latch and interfacing with a first surface on said return spring for biasing said secondary latch for rotation in a counterclockwise direction.

8. The circuit breaker of claim 7 including an extension on said reset spring interfacing with said first surface on said retrurn spring to prevent said secondary latch from rotating in said counterclockwise direction.

9. The circuit breaker of claim 7 including a bottom surface on said cradle hook contacting said reset spring extension and driving said extension into said first surface on said return spring releasing said bottom surface of said secondary latch thereby allowing said secondary latch to rotate in said counterclockwise direction.

10. The circuit breaker of claim 8 wherein said return spring includes a second surface co-planar with said first surface, said second surface interfacing with said secondary latch thereby biasing said secondary latch for rotation in a clockwise direction.

11. The circuit breaker of claim 8 including a first surface on said reset spring interfacing with said primary latch for biasing said primary latch for rotation in a said clockwise direction.

12. The circuit breaker of claim 11 including an aperture formed within said primary latch for retaining said cradle hook.

13. The circuit breaker of claim 9 wherein said bottom surface on said cradle hook contacts said primary latch and rotates said primary latch in said clockwise direction.

* * * * *